US008109262B2

(12) United States Patent
Castonguay et al.

(10) Patent No.: US 8,109,262 B2
(45) Date of Patent: Feb. 7, 2012

(54) AGING APPARATUS FOR AGING AN ARTIFICIAL STONE

(75) Inventors: Bertin Castonguay, Magog (CA); Manon Helie, l'Epiphanie (CA)

(73) Assignee: Oldcastle Building Products Canada Inc. (CA)

( * ) Notice: Subject to any disclaimer, the term of this patent is extended or adjusted under 35 U.S.C. 154(b) by 0 days.

(21) Appl. No.: 13/098,540

(22) Filed: May 2, 2011

(65) Prior Publication Data

US 2011/0207386 A1 Aug. 25, 2011

Related U.S. Application Data

(63) Continuation of application No. 11/577,328, filed as application No. PCT/CA2005/001584 on Oct. 14, 2005, now Pat. No. 7,954,482.

(60) Provisional application No. 60/618,591, filed on Oct. 15, 2004.

(51) Int. Cl.
*B28D 1/20* (2006.01)

(52) U.S. Cl. ..... 125/13.01; 299/39.1; 451/352; 451/495; 451/518

(58) Field of Classification Search ..... 15/236.04, 15/93.1, 230.14; 125/13.01, 37, 15; 299/39.1, 299/41.1, 73, 74, 75, 77; 451/65, 259, 261, 451/262, 359, 495, 353, 518, 519, 352
See application file for complete search history.

(56) References Cited

U.S. PATENT DOCUMENTS 1,932,319 A * 10/1933 Myers ..... 451/353
2,713,757 A * 7/1955 Ernst ..... 451/353
3,464,166 A * 9/1969 Bouvier ..... 451/548
3,536,150 A 10/1970 Stebley
3,834,200 A 9/1974 Winter
3,870,423 A 3/1975 Peitz, Jr.
3,947,192 A 3/1976 Rosenberger
4,219,898 A * 9/1980 Presby ..... 15/49.1
4,295,274 A 10/1981 Bricher et al.

(Continued)

FOREIGN PATENT DOCUMENTS

DE 361276 10/1922

(Continued)

OTHER PUBLICATIONS

Affidavit of John Sterling, Clearford Industries Inc. and the Registrar of Trademarks, Federal Court of Canada, Sworn Aug. 29, 2008.

(Continued)

*Primary Examiner* — Timothy V Eley
(74) *Attorney, Agent, or Firm* — Kilpatrick Townsend & Stockton LLP

(57) ABSTRACT

The present invention provides an apparatus and a method for aging a stone, preferably an artificial stone. The aging device comprises a rotary support operatively connected to a rotary shaft, at least one abrasive tool mounted to the rotary support for roughing and/or polishing a surface of the artificial stone when the rotary support is brought into functional contact with said surface, and biasing means that biasingly connect the abrasive tool to the rotary support. The biasing means urge the abrasive tool away from the rotary support while allowing the same to move toward the rotary support when the rotary support is brought into functional contact with the surface of the artificial stone, thereby allowing the abrasive tool to follow a surface profile of the artificial stone while roughing and/or polishing its surface.

13 Claims, 13 Drawing Sheets

U.S. PATENT DOCUMENTS

| | | | | |
|---|---|---|---|---|
| 4,451,093 | A | | 5/1984 | Perez |
| 4,486,931 | A | * | 12/1984 | Pichelman et al. ..... 29/81.05 |
| 4,614,380 | A | * | 9/1986 | Allen ..... 299/41.1 |
| 4,669,556 | A | | 6/1987 | Barr et al. |
| 4,758,050 | A | * | 7/1988 | Peterson et al. ..... 299/41.1 |
| 4,939,872 | A | * | 7/1990 | Revelin et al. ..... 451/354 |
| 5,081,734 | A | * | 1/1992 | Sandford et al. ..... 15/93.1 |
| 5,286,139 | A | | 2/1994 | Hair |
| 5,342,142 | A | | 8/1994 | Barth et al. |
| 5,348,417 | A | | 9/1994 | Scheiwiller |
| 5,409,299 | A | * | 4/1995 | Holder ..... 299/41.1 |
| 5,496,206 | A | | 3/1996 | Young |
| 5,625,990 | A | | 5/1997 | Hazlett |
| 5,713,155 | A | | 2/1998 | Prestele |
| 5,921,705 | A | | 7/1999 | Hodson et al. |
| 6,021,771 | A | * | 2/2000 | Swan et al. ..... 125/5 |
| 6,109,906 | A | | 8/2000 | Castonguay et al. |
| 6,196,911 | B1 | | 3/2001 | Preston et al. |
| 6,234,882 | B1 | | 5/2001 | Young |
| 6,279,291 | B1 | | 8/2001 | Geusens et al. |
| 6,321,740 | B1 | | 11/2001 | Scherer et al. |
| 6,540,501 | B1 | | 4/2003 | Bott |
| 6,561,786 | B2 | | 5/2003 | Ciccarello |
| 6,575,727 | B2 | | 6/2003 | Ciccarello et al. |
| 6,638,151 | B2 | * | 10/2003 | Ueno ..... 451/359 |
| 6,739,957 | B2 | * | 5/2004 | Peterson et al. ..... 451/162 |
| 7,954,482 | B2 | | 6/2011 | Castonguay et al. |
| 2002/0056771 | A1 | | 5/2002 | Zehr |
| 2002/0092257 | A1 | | 7/2002 | Scherer et al. |
| 2002/0145224 | A1 | | 10/2002 | Ciccarello |
| 2002/0158363 | A1 | | 10/2002 | Ciccarello et al. |
| 2003/0138516 | A1 | | 7/2003 | Hess et al. |
| 2003/0173697 | A1 | | 9/2003 | Ciccarello et al. |
| 2003/0180099 | A1 | | 9/2003 | Scherer et al. |
| 2004/0150131 | A1 | | 8/2004 | Grubb |
| 2008/0032607 | A1 | | 2/2008 | Castonguay et al. |

FOREIGN PATENT DOCUMENTS

| | | | |
|---|---|---|---|
| EP | 0339308 | | 11/1989 |
| EP | 0860258 | | 8/1998 |
| JP | 2002285504 | | 10/2002 |
| WO | WO-8607292 | A1 | 12/1986 |
| WO | WO-2004067242 | | 8/2004 |

OTHER PUBLICATIONS

EPO Application No. 05797177.2, "Supplementary European Search Report", mailed Sep. 28, 2010.

* cited by examiner

AGING APPARATUS FOR AGING AN ARTIFICIAL STONE

CROSS-REFERENCE TO RELATED APPLICATIONS

This application is a continuation of U.S. Ser. No. 11/577,328 filed on 16 Apr. 2007, now allowed, which is the U.S. National Phase of PCT/CA2005/001584 filed on 14Oct. 2005 which claims the benefit of U.S. Provisional Patent Application No. 60/618,591 filed on 15 Oct. 2004, the contents of each of which are incorporated by reference herein.

FIELD OF THE INVENTION

The present invention relates generally to apparatuses and methods for treating the surface of an object, including the faces and edges of the object. More particularly, it relates to an apparatus and a method for aging surfaces of artificial stones, pavers, cobblestones, slabs, curbs, masonry units or steps made of concrete, such as those used for landscaping, masonry and/or decorative purposes.

BACKGROUND OF THE INVENTION

For a long time, craftsmen have been using various techniques to give objects a rustic look, objects that, otherwise, would all look alike. For example, various stone aging techniques can be used when a person wishes to pave his driveway with concrete blocks while still preserving the rustic look of his house and landscape. In that case, a good solution is to use concrete blocks having a rough, old-looking surface. The current techniques for providing such an antique aspect to an object are most of the time old-fashioned, manual techniques. Even though the result might be adequate, the process of manually crafting the surface of an object to give it a rustic look is long, arduous, inefficient and uneconomical.

In order to facilitate stone aging processes, various apparatuses have been developed for roughing or texturing the surface of an object and have been disclosed in recent years.

Among those there are the tumbler type apparatuses wherein concrete blocks are exposed to tumbling operations. Such techniques are however time consuming and may require additional steps and/or operations in the handling of the blocks prior and after such exposure. Indeed the textured blocks exit the tumbler in a disorderly fashion and have to be reorganized in piles These handling steps are obviously time-consuming. An example of such apparatuses is disclosed in WO2004/067242 (GRUBB). Tumbling apparatus present the disadvantage of not being able to treat or age large thin stones, or fragile stones, and such stone would be damaged rather than aged.

Other apparatuses using a conveyor to transport the concrete blocks to a surface treatment section have also been developed in the prior art. Example of those are disclosed in U.S. Pat. No. 5,496,206 (YOUNG), U.S. Pat. No. 6,109,906 (CASTONGUAY et al.); U.S. Pat. No. 6,540,501 (BOTT); US 2002/0145224 (CICCARELLO); US 2002/015863 (CICCARELLO et al.), U.S. Pat. No. 6,561,786 (CICCARELLO), U.S. Pat. No. 6,575,727 (CICARRELLO et al.), US 2003/0173697 (CICCARELLO et al.). One drawback however with most of these apparatuses is that, although they do roughen the surface of concrete blocks, they do not provide a satisfactory real, natural, antique look.

Also known in the art are U.S. Pat. No. 6,321,740 (SCHERER et al.), US 2002/0092257 (SCHERER et al.), US 2003/0180099 (SCHERER et al.), which disclose various devices and methods for roughing the surface of masonry blocks or artificial stone blocks.

Also known in related art are the following documents: U.S. Pat. No. 3,536,150 (STEBLEY), U.S. Pat. No. 3,834,200 (WINTER), U.S. Pat. No. 4,451,093 (PEREZ), U.S. Pat. No. 4,669,556 (BARR et al.), No. US 2002/0056771 (ZEHR), and No. US 2003/0138516 (HESS et al.).

Since the market for concrete blocks with a rough, old-looking surface is developing and demand for such products is growing, there is indeed a need for an apparatus or method that can rapidly bestow an antique look on an object in an efficient and economical manner.

SUMMARY OF THE INVENTION

An object of the present invention is to provide a stone aging device that satisfies the above mentioned need and that overcomes several of the drawbacks encountered in the above mentioned prior art.

The present invention provides an apparatus and a method for aging a stone, preferably an artificial stone. By "stone", it is meant any artificial concrete block devised to be treated in order to create a textured or antique appearance, as well as any natural stone or rock to which an aging treatment is to be applied. The expression artificial stone when used in the present description is intended to encompass artificial pavers, cobblestones, slabs, curbs, masonry units or steps made of concrete but may also include naturally occurring stones to be artificially aged. The apparatus and method according to the present invention enables a stone to be processed and thereby given an antique textured look to its surface. It is worth mentioning that the expression "surface" when used in the present description is intended to encompass the outer boundary of the faces and/or edges of the stone The present invention also provides an apparatus and method for mass production of stones having rough surfaces.

According to the present invention, an aging device for aging a stone is provided. The aging device comprises a rotary support operatively connected to a rotary shaft. It also comprises at least one abrasive tool mounted to the rotary support for roughing and/or polishing a surface and corresponding peripheral edges of the stone when the rotary support is brought into functional contact with said surface. The device further comprises biasing means that biasingly connect the abrasive tool to the rotary support. The biasing means urge the abrasive tool away from the rotary support while allowing the same to move toward the rotary support when the rotary support is brought into functional contact with the surface of the stone, thereby allowing the abrasive tool to follow a surface profile of the stone while roughing and/or polishing its surface.

The present invention also provides an aging method for aging a stone.

The stone aging method comprises the following steps:

a) providing a stone having a surface to be aged;
b) bringing the artificial stone into rotational contact with at least one abrasive tool;
c) urging the abrasive tool toward the surface of the stone while allowing the same to move away therefrom, thereby allowing the abrasive tool to follow a surface profile of the stone while roughing and/or polishing the surface thereof; and
d) maintaining contact between the abrasive tool and the surface of the stone until aged.

The rotary support is preferably a disk-shaped plate, which rotates about a central axis thereof, or a rotary support in the form of a cylinder.

The rotary support is advantageously provided with a protective plate mounted to the plate to substantially shield the biasing means, and in certain cases to preload the same. Openings are provided in the protective plate through which the abrasive tool are urged by the biasing means.

The combination of the abrasive tool and the biasing means make up an "aging unit," that can take a variety of forms and embodiments which comprise combinations of flexing rods, flexing bases, compression or torsion springs, lever arms, guiding sleeves, suspension units, spring blades, as well as abrasive tools with a variety of shapes and sizes mounted to engage the surface of the artificial stone.

In a first embodiment of the invention, the aging device includes spring blades arranged around the rotary support and fixed thereto, each of the spring blades being separated into various strip ends. Onto each extending point of the strip ends is attached an abrasive tool.

In a second embodiment of the invention, the aging device includes a plurality of double rod systems flexibly mounted to the rotary plate via connectors, and having an abrasive tool mounted at the end extending away from the rotary support.

In a third embodiment of the invention, the aging device includes a plurality of biasing arms each mounted to the rotary plate on a compression spring. The biasing ability in this case is substantially due to the springs. At one end of each biasing arm, an abrasive tool is mounted. The biasing arm is able to pivot and move up and down on the compression spring.

In a fourth embodiment of the invention, the aging device includes a plurality of abrasive tools directly mounted to corresponding compression springs, which are in turn mounted to the rotary support. Each abrasive tool is mounted to a compression spring and laterally surrounded and stabilized by a guiding sleeve.

In a fifth embodiment of the invention, the aging device includes a plurality of flexible spring arms fixedly mounted to the rotary support. At the end of each flexible spring arm an abrasive tool is mounted. In this embodiment, the flexing arm itself acts as the biasing means bending and flexing in various directions in response to the surface profile of the stone to be aged.

In a sixth embodiment of the invention, the aging device includes a plurality of spring blades each mounted to a base with a locking plate. The base is fixed to the rotary support. The abrasive tool is mounted to the extending end of the spring blade.

In a seventh embodiment of the invention, the aging device includes a plurality of L-shaped biasing arms pivotally mounted to a suspension unit. The suspension unit provides the biasing force and it is fixedly mounted to the rotary support. The L-shaped biasing arms each extend substantially vertically from the pivot point and then substantially horizontally. At one end of the horizontal projection, the abrasive tool is mounted to the end of the L-shaped biasing arm.

In an eighth embodiment of the invention, the aging device includes a plurality of curved biasing arms pivotally mounted to a suspension unit. The suspension unit provides the biasing force and it is fixedly mounted to the rotary support. The curved biasing arms each extend obliquely from the pivot point and at the opposite end thereof the abrasive tool is mounted.

The abrasive tool is advantageously made of stainless steel or carbide, but can also be made of any hard material capable of roughing the surface of artificial stone.

As can be appreciated, one advantage of the aging device according to the invention as compared to a prior art tumbler type apparatus is that it allows the aging of large, thin stones without running the risk of breaking the same.

The aging method according to the present invention preferably has a conveying step for bringing the artificial stones into contact with the stone aging apparatus. This also enables the efficient mass production of the aged stones.

BRIEF DESCRIPTION OF THE DRAWINGS

These and other objects and advantages of the invention will become more apparent upon reading the detailed description and upon referring to the drawings in which.

Figure 1:
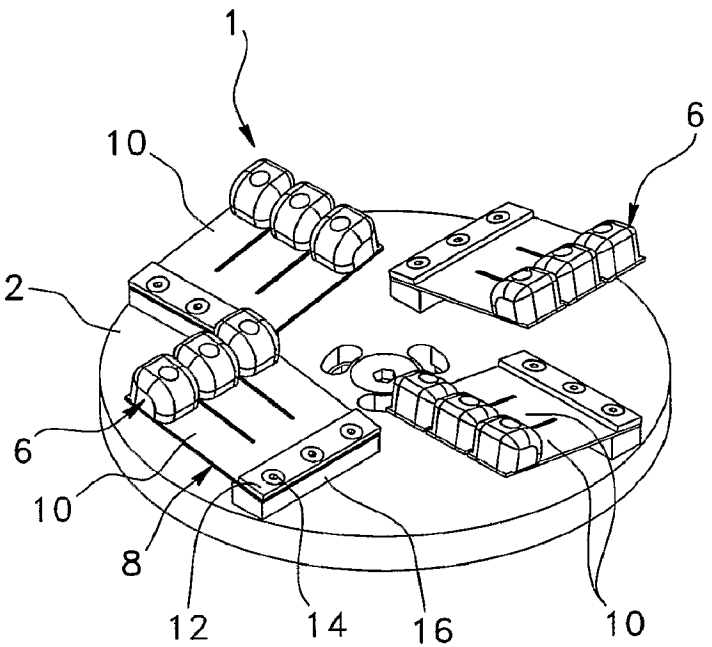
FIG. 1 is a top perspective view of the stone aging device according to the first embodiment of the invention.

While the invention will be described in conjunction with an example embodiment, it will be understood that it is not intended to limit the scope of the invention to such embodiment. On the contrary, it is intended to cover all alternatives, modifications and equivalents as may be included as defined by the appended claims.

DESCRIPTION OF PREFERRED EMBODIMENTS

In the following description, similar features in the drawings have been given similar reference numerals and in order not to unduly weigh down the figures. Also, some elements are not referred to in some figures if they were already identified in a precedent figure.

The stone aging device, in its various embodiments that can be seen in FIGS. 1 to 27, is suitable for aging all sorts of artificial stones, but may also be used for aging other stone materials. It is particularly adapted for aging artificial stones, such as square and flat blocks made of concrete, cement, composites of other naturally occurring stone materials, and dried, poured or petrified stone materials. The device is also particularly useful for aging cast concrete blocks, stones or flagstones used for pavement or for covering a wall surface. Nevertheless, the device can also be used to age naturally occurring rocks and stone materials.

The aged artificial stones can be used in a variety of ways, including for covering walls, floors or ceilings, for constructing retaining walls or paving walkways, or for aesthetic display in a garden or home.

The surface profile of the artificial stone is substantially what gives it its aged look. To give the stone a surface profile having natural looking lines and/or grooves, recesses and/or raised parts, bumps and/or a stratified-looking aspect, is the goal of aging the stone. The surface profile can be preconceived in a general or specific manner, or randomized. The arrangement and design of the abrasive tools and the biasing means as well as the operating conditions can be chosen according to the desired surface profile.

The term "aged" as used in the present application, refers to the state of an object as it appears. An aged stone, therefore, is a stone that appears to be old, rustic, etc. However, an "aged" stone can also be a stone that has undergone a distressing treatment, and thus has a certain look to it. The aging can occur on the surface and/or the edges of the stone. Also, the "aging effect" can bestow various predefined patterns, natural looking or not, on the treated ("aged") stone. Therefore, the term "aged stone" should be interpreted in a general sense of a treated or processed stone that has acquired a certain look therefrom. Another term sometimes used in the art to describe an "aged" stone is "distressed".

Referring to FIGS. 1 to 27, the stone aging device 1 for aging an artificial stone comprises a rotary support 2 adapted to be connected to a rotary shaft 4. The rotary shaft 4 is preferably driven by a motor (not shown) to continuously rotate the rotary support 2. The rotation of the rotary support 2 is preferably continuous and unidirectional, but can also be alternating, depending on the desired type of aging and required operating conditions. The aging device further comprises at least one abrasive tool 6, and preferably a plurality of abrasive tools 6, mounted to the rotary support 2 for roughing and/or polishing the surface (uneven or even) of the artificial stone while the rotary support 2 and the artificial stone are brought into functional contact with each other. By "functional contact" it is understood that the rotary support 2 is brought close enough to the surface of the artificial stone so as to enable the abrasive tools 6 to engage the surface in a manner suitable for aging the stone. The rotary support therefore usually does not directly engage or contact the stone surface, but enables the abrasive tools to do so.

Biasing means are provided for biasingly connecting the abrasive tools 6 to the rotary support 2 and allowing the abrasive tools 6 to move freely towards the rotary support 2 when it is brought into functional contact with the surface of the artificial stone; thereby allowing the abrasive tools 6 to follow the surface profile of the stone upon aging the same. FIGS. 3, 6, 9, 13, 16, 19, 23 and 25 show an enlarged view of different embodiments of the biasing means, each of which are further discussed and described herein below. The biasing means enable the abrasive tools 6 to normally engage the surface of the stone. Upon rotation of the rotary support 2, driven by the rotary shaft 4, preferably at high speeds, the abrasive tools 6 come into contact with the surface of the stones, thereby aging the surfaces and edges of the stones mostly by friction but also by impact. The degree to which the abrasive tools "bounce" and thus engage the surface of the stones by impact, depends on the biasing means and the operating conditions used, among other factors.

According to the first to eighth preferred embodiments of the invention, as shown in FIGS. 1 to 26, the rotary support 2 advantageously comprises a disk-shaped plate that is rotated about a radial axis thereof. The rotary shaft 4 is preferably adapted to the center of the disk-shaped (circular) plate. A plurality of aging units, which comprise biasing means, abrasive tools and various connection elements, are mounted to the disk-shaped plate on the opposite side of the rotary shaft 4.

Figure 2:
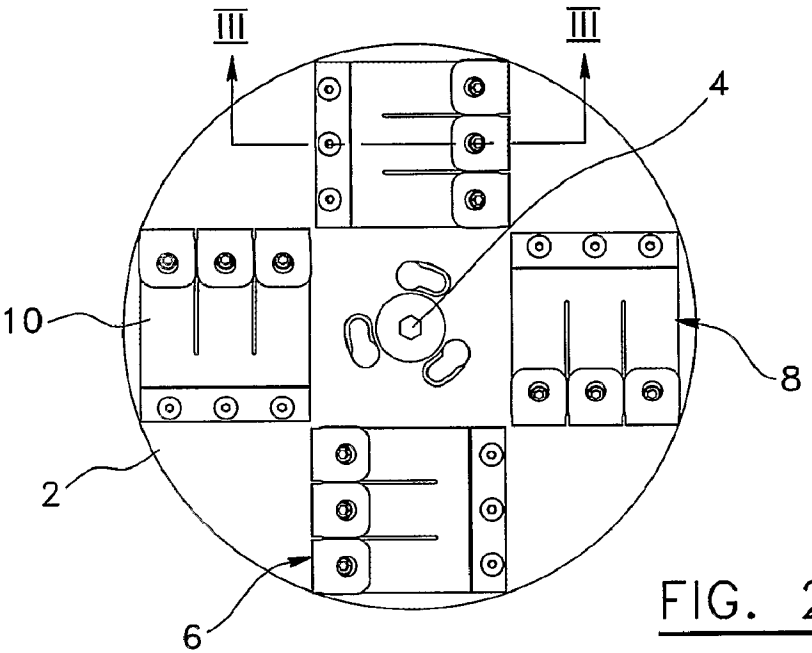
FIG. 2 is a top view of the aging device of FIG. 1.
Figure 3:
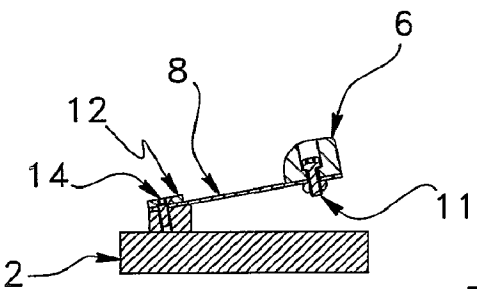
FIG. 3 is a side view along the line III-III of FIG. 2, showing one aging unit of the device.

Referring to FIGS. 1 to 3, the first preferred embodiment of the aging device 1 is provided with an abrasive tool 6 mounted to biasing means that comprise spring blades 8 each having a first end portion 12 secured to the rotary support 2, and at least one second end portion 10 extending away from the rotary support 2, the abrasive tools 6 being secured to the second end portion 10. The second end portions 10 are substantially strip shaped, the flat side facing the stone to be aged. There are preferably numerous second end portions 10, each of which is provided with an abrasive tool 6. As seen in FIG. 3, the abrasive tool is attached to the spring blade second end 10 with a screw 11 that screws in from the under side of the spring blade 8. The carbide tool 6 is curved on its inner side and right-angled on the far side, but its shape can vary according to the desired aging effect. The first end portion 12 is preferably mounted with screws 14 to a base 16, which is fixedly mounted to the rotary support 2. The spring blades 8 have tensional give that enables them to urge the abrasive tools 6 toward the surface of the stone material. The spring blades 8 adapt and bend substantially normally, that is up and down, with respect to the surface of the rotary support 2, and lateral (that is, radial) movement is quite minimal. Also, depending on the surface profile, each end portion 10 of the spring blade 8 can have a certain independence of movement, as they are separated from each other.

Figure 4:
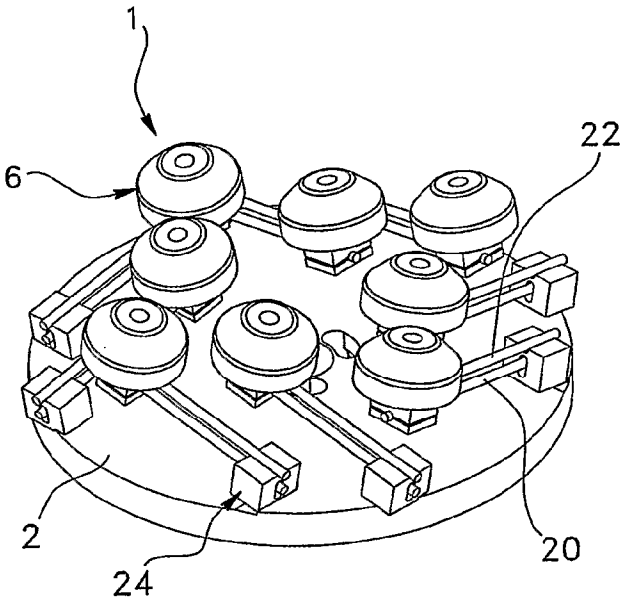
FIG. 4 is a top perspective view of the aging device according to the second embodiment of the invention.
Figure 5:
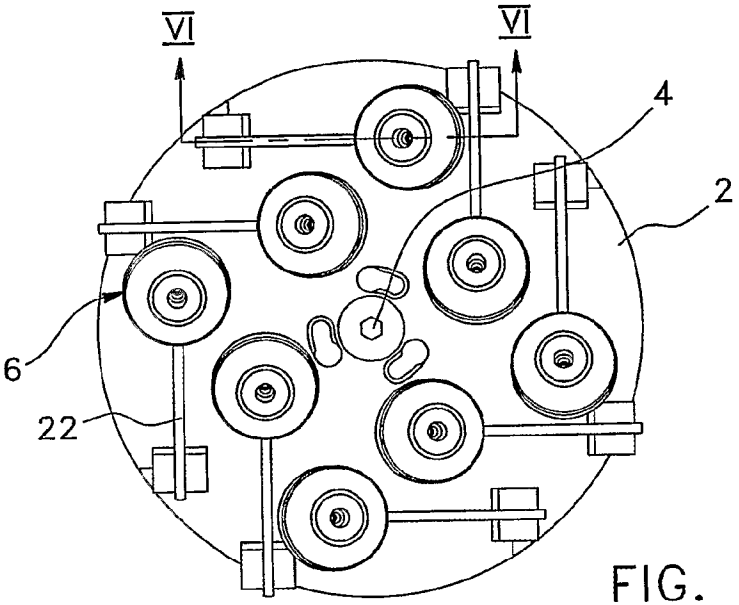
FIG. 5 is a top view of the aging device of FIG. 4.
Figure 6:
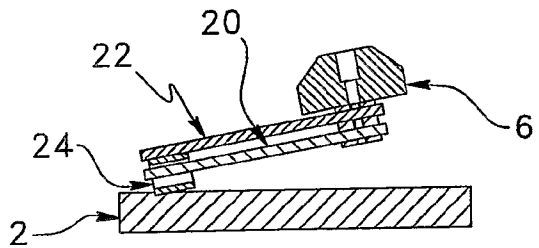
FIG. 6 is a side view along the line VI-VI of FIG. 5, showing one aging unit of the device.
Figure 7:
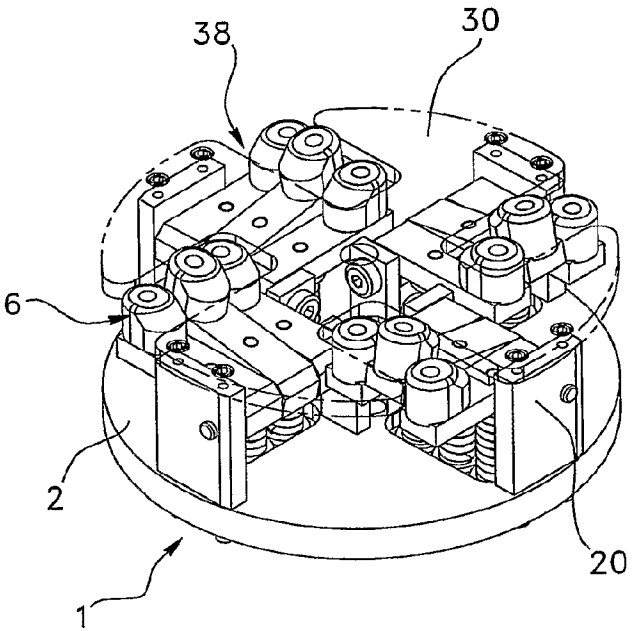
FIG. 7 is an open top perspective view of the aging device according to the third embodiment of the invention.
Figure 8:
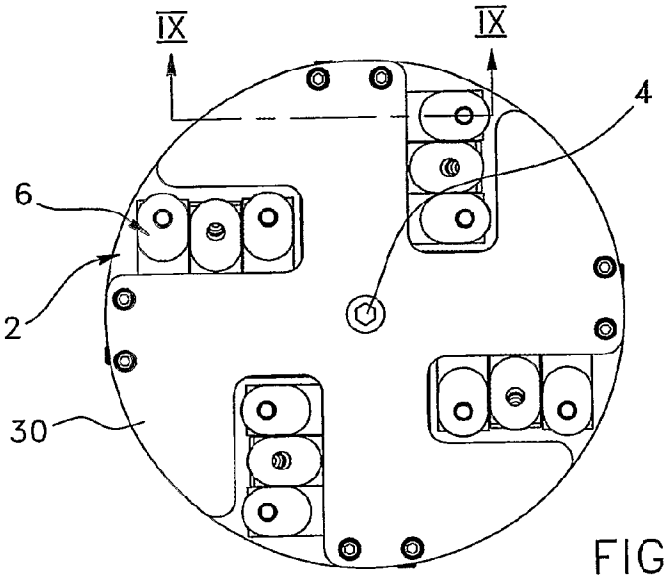
FIG. 8 is a top view of the aging device of FIG. 7.
Figure 9:
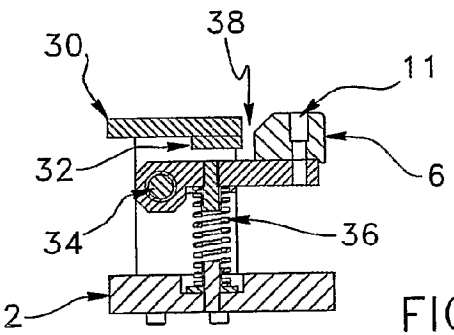
FIG. 9 is a side view along the line IX-IX of FIG. 8, showing one aging unit of the device.
Figure 10:
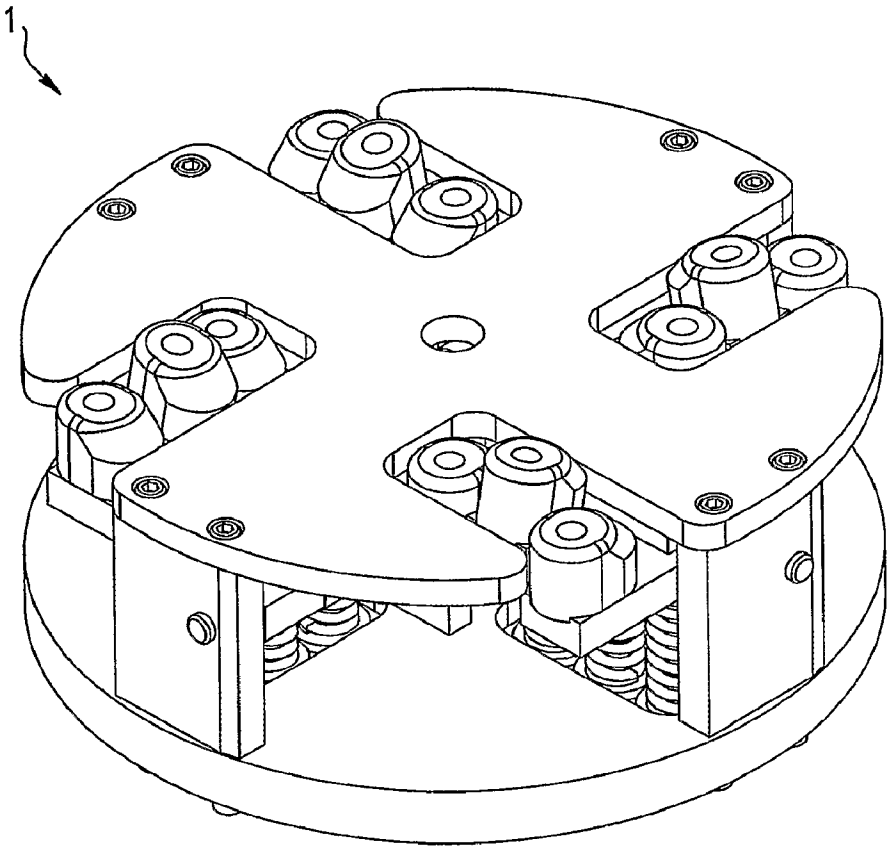
FIG. 10 is a top perspective view of the aging device according to the third embodiment of the invention.

Referring to FIGS. 4 to 6, the second preferred embodiment of the aging device 1 is provided with an abrasive tool 6 mounted to biasing means that comprise a double rod system. In this system, as particularly shown in FIG. 6, a guide rod 20 is mounted to a flexing rod 22 at their two respective extremities. The flexing rod 22 is preferably arranged above the guide rod 20 and the double rod system is fixedly mounted to the rotary support 2 at a fixed base 24. The guide rod 20, being more rigid, stiffens up the movement of the carbide tool 6 against the stone, while the flexing rod 22 enables the tool 6 to adapt to minor variations in the surface profile of the stone material. The rigidity and flexibility of the two rods 20, 22 can be varied according to the desired aging effect. The base 24 is preferably connected at the perimeter of the disk-shaped rotary disk plate 2, and the rods extend obliquely upward and obliquely relative to the tangent of the perimeter at their bases 24, so that the abrasive tools 6 are disposed within the perimeter of the disk-shaped plate 2, at various distances from the center. The height of each abrasive tool 6 from the surface of the plate 2 is substantially similar.

Referring to FIGS. 7 to 10, the third preferred embodiment of the aging device 1 is provided with an abrasive tool 6 mounted to biasing means that are substantially covered and protected by a protective plate 30. The protective plate shields and preloads the biasing means. It is worth mentioning that all the other embodiments shown can also be provided with a similar protective plate. The biasing means, as shown particularly in FIG. 9, comprise a biasing arm 34 extending parallel with the surface of the disk-shaped support 2 and connected thereto via a compression spring 36. The protective plate 30 also comprises stop guides 32 that stop the upward movement of the basing arm 34 toward the stone. The stop guides are mounted adjacent to respective openings 38 in the protective plate 30. It is through these openings that the corresponding abrasive tools 6 are urged by the biasing means. Advantageously, the biasing arm 34 pivots on the compression spring 36 and is biased up and down thereon. Therefore, the abrasive tools 6 can follow the surface profile of the stone being aged by adapting thereto with a range of movements. Preferably still, the biasing means are arranged so that the abrasive tools 6 project through the openings 38 in clusters, as clearly shown in FIGS. 7, 8 and 10. Also, the abrasive tools 6 arranged in clusters are of different heights relative to the protective plate 30, so as to enable different friction effects on different parts of the stone. These variable heights can be achieved by different sizes of stop guides, for example, or different spring lengths.

Figure 11:
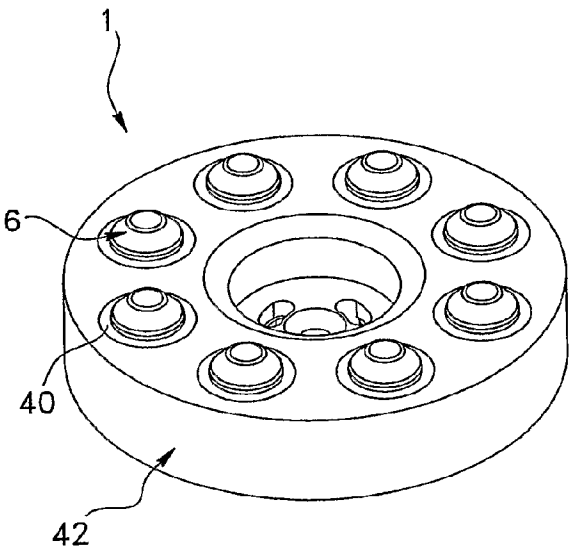
FIG. 11 is a top perspective view of the aging device according to the fourth embodiment of the invention.
Figure 12:
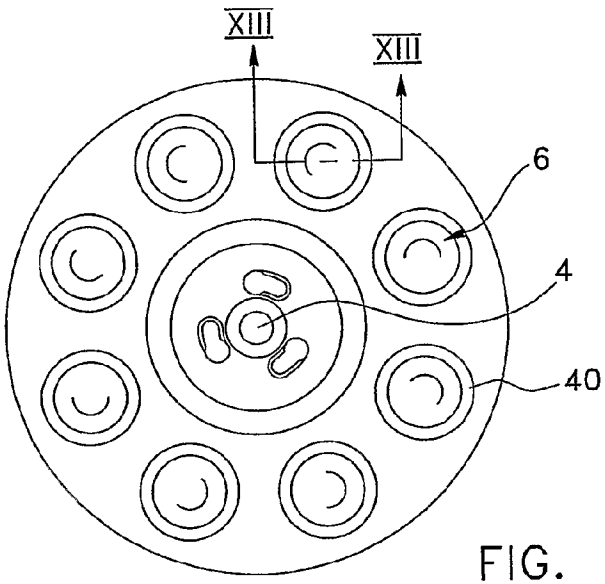
FIG. 12 is a top view of the aging device of FIG. 11.
Figure 13:
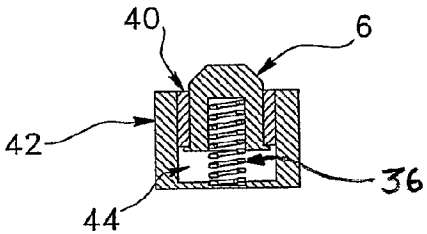
FIG. 13 is a side view along the line XIII-XIII of FIG. 12, showing one aging unit of the device.

Referring to FIGS. 11 to 13, the fourth preferred embodiment of the aging device 1 is provided with an abrasive tool 6 mounted to biasing means that comprise a compression spring 36. In this case, the tools 6 are mounted directly to the compression spring 36 and are biased in a substantially vertical direction, that is, normal to the surface of the rotary support 2. The abrasive tools 6 are each surrounded with a guide sleeve 40, which in turn abuts on the base plate 42. In this preferred embodiment, the base plate 42 is a structure that comprises the disk-shaped plate and the protective plate and a cylindrical wall connecting them along their circumferences. The base plate 42 is preferably a thick disk into which holes 44 have been bored. Into the holes 44 are mounted each biasing means and abrasive tool 6, which the guide sleeve 40 maintains in place.

Figure 14:
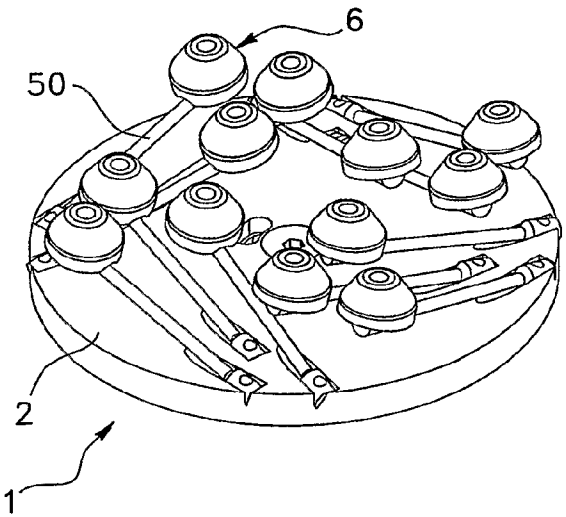
FIG. 14 is a top perspective view of the aging device according to the fifth embodiment of the invention.
Figure 15:
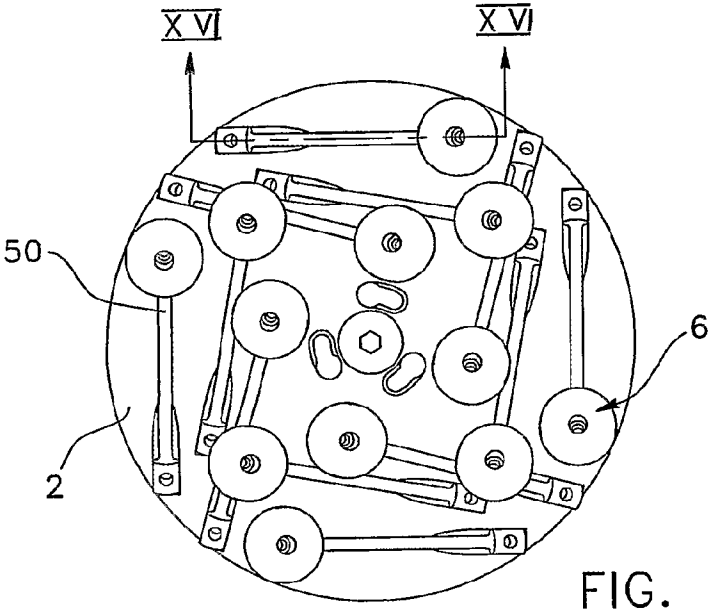
FIG. 15 is a top view of the aging device of FIG. 14.
Figure 16:
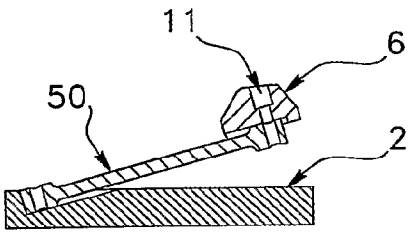
FIG. 16 is a side view along the line XVI-XVI of FIG. 15, showing one aging unit of the device.
Figure 17:
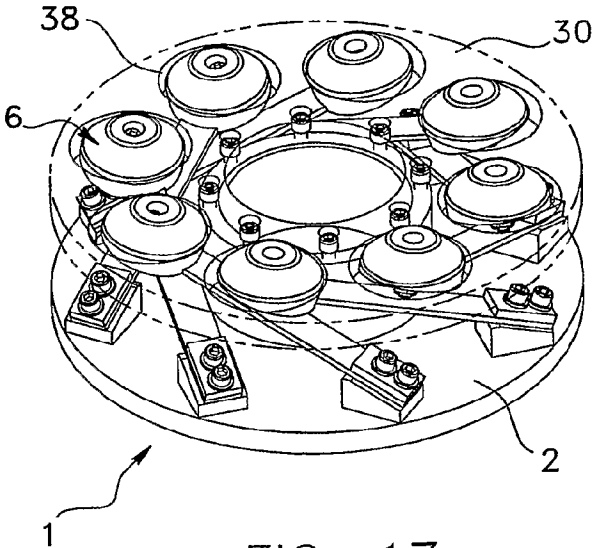
FIG. 17 is an open top perspective view of the aging device according to the sixth embodiment of the invention.
Figure 18:
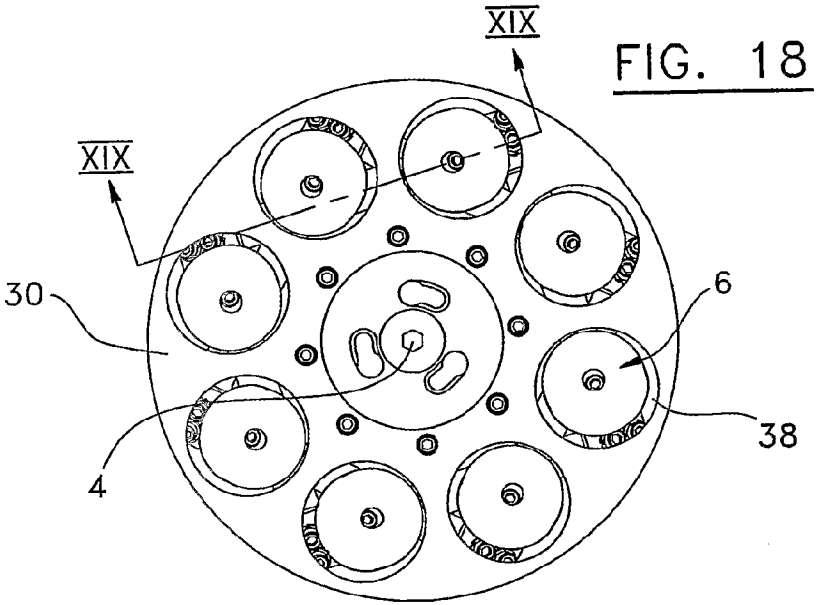
FIG. 18 is a top view of the aging device of FIG. 17.
Figure 19:
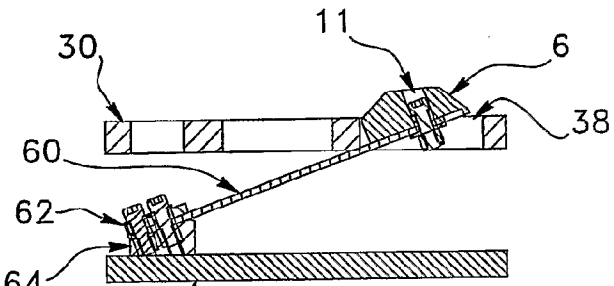
FIG. 19 is a side view along the line XIX-XIX of FIG. 18, showing one aging unit of the device.
Figure 20:
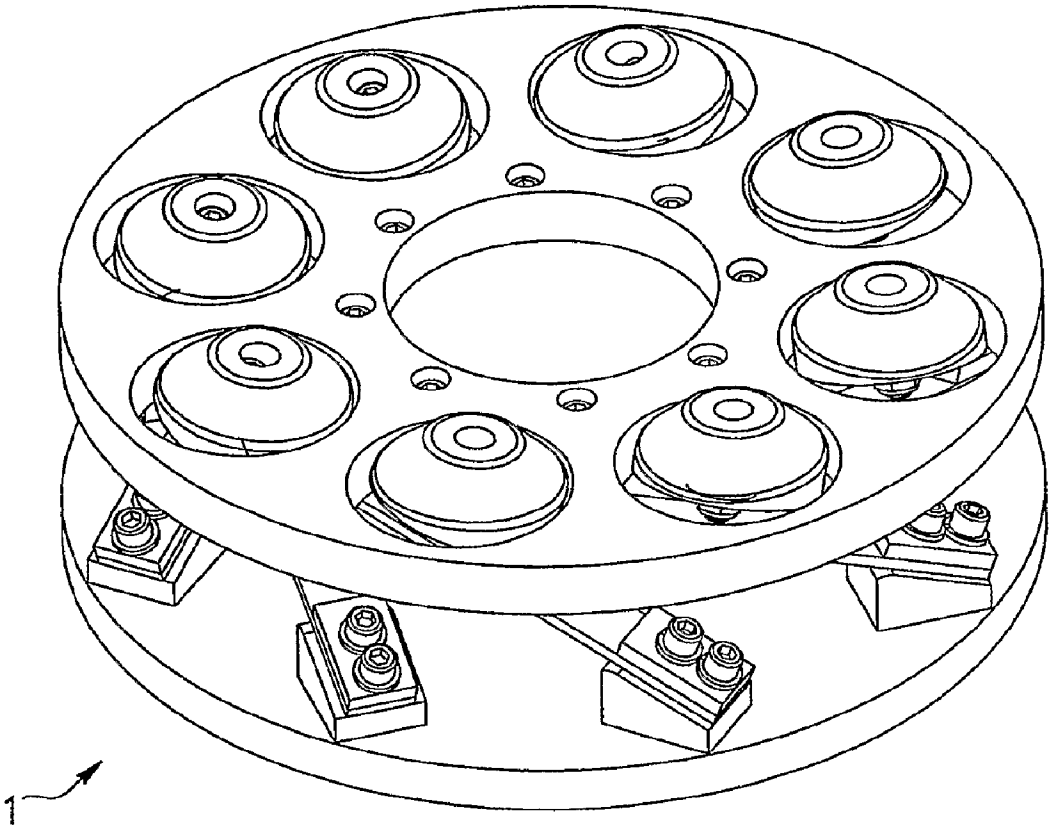
FIG. 20 is a top perspective view of the aging device according to the sixth embodiment of the invention.
Figure 21:
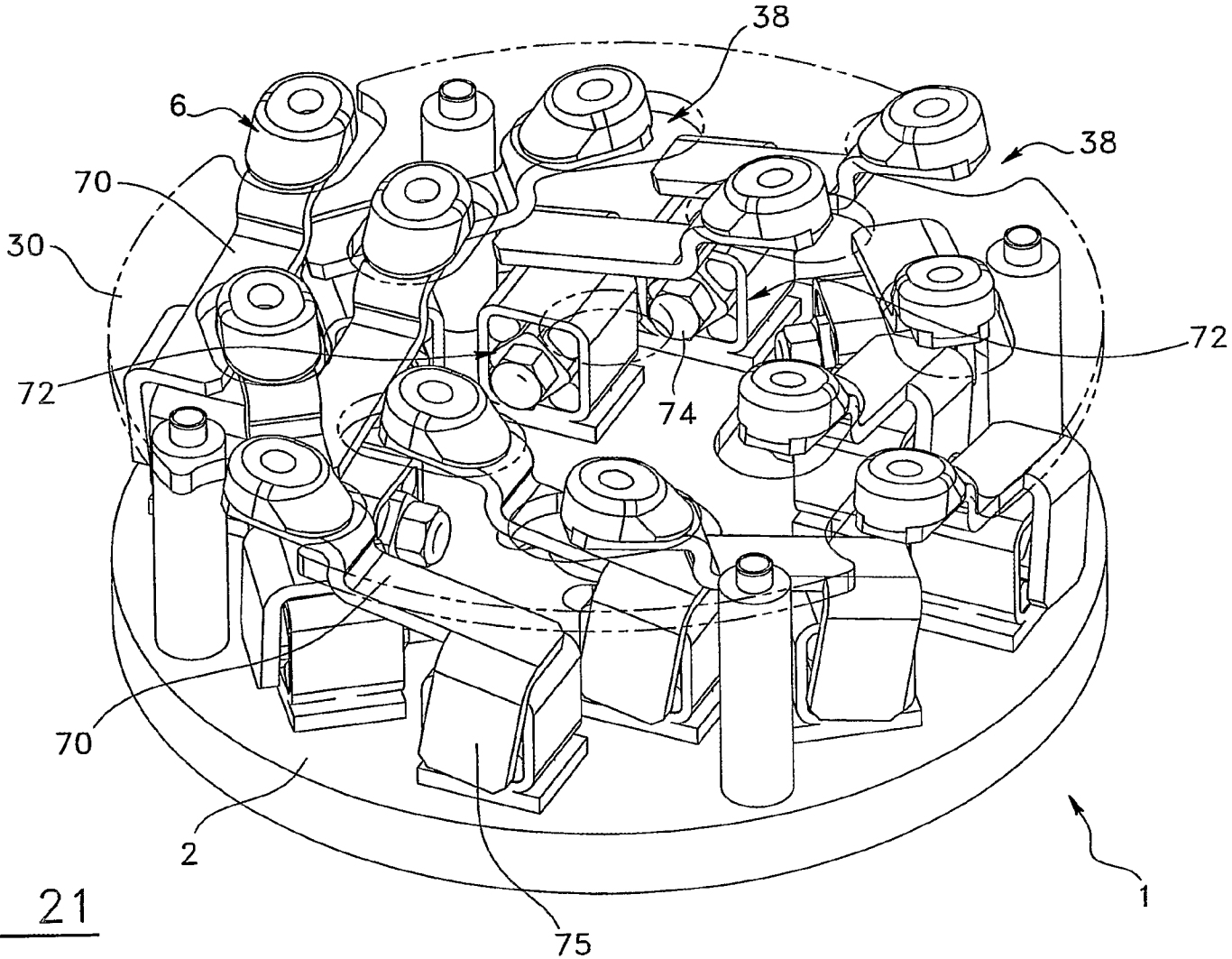
FIG. 21 is an open top perspective view of the aging device according to the seventh embodiment of the invention.
Figure 22:
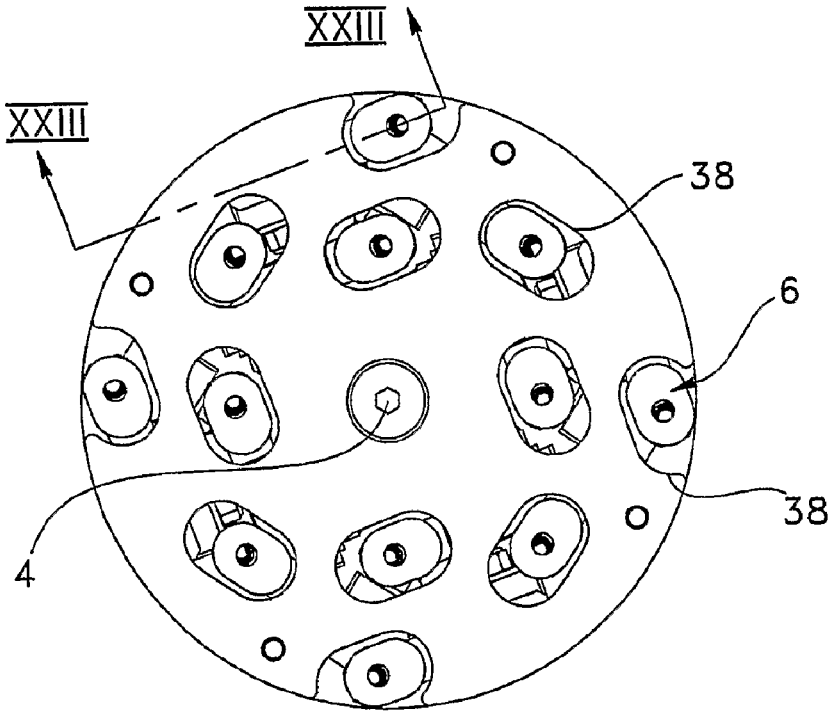
FIG. 22 is a top view of the aging device of FIG. 21.
Figure 23:
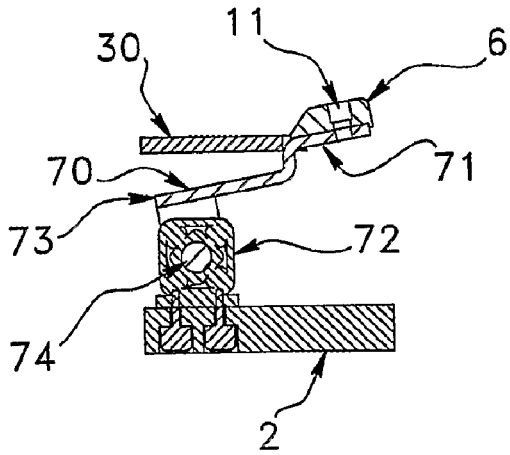
FIG. 23 is a side view along the line XXIII-XXIII of FIG. 22, showing one aging unit of the device.
Figure 24:
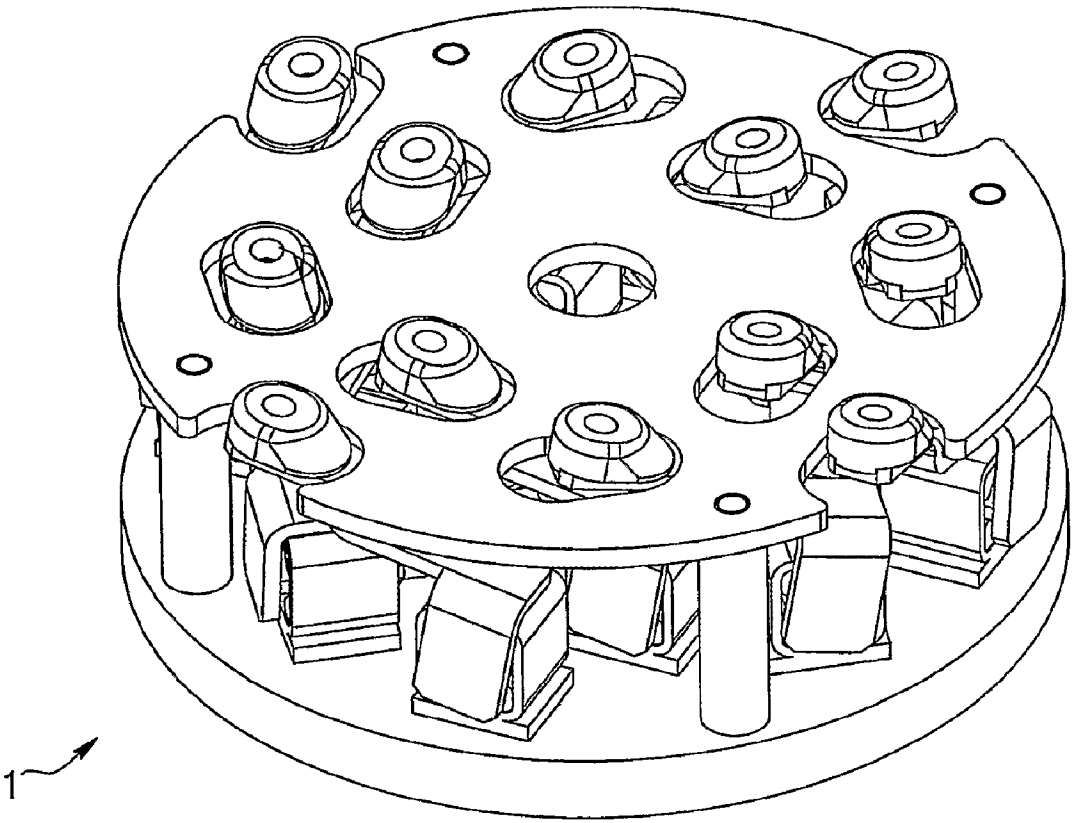
FIG. 24 is a top perspective view of the aging device according to the seventh embodiment of the invention.

Referring to FIGS. 14 to 16, the fifth preferred embodiment of the aging device 1 is provided with an abrasive tool 6 mounted to biasing means that comprise a flexible spring arm 50 mounted to the rotary support 2. The flexible spring arm 50 has a first and a second end, and is preferably mounted at its first end in a groove of the support 2. The second end of the spring arm 50 extends freely away from the support 2, preferably at an oblique angle from the surface of the latter. The spring arm 50 bends when the abrasive tool 6 comes into contact with the stone. There is preferably a plurality of abrasive tools 6 each mounted to a spring arm 50, and arranged in clusters, as shown in FIGS. 14 and 15. The spring arms 50 enable a substantially axial movement of the abrasive tools 6 relative to the disk-shaped plate 2, but also enable radial movements, as the arms 50 are bendable in any direction.

Referring to FIGS. 17 to 20, the sixth preferred embodiment of the aging device 1 is provided with an abrasive tool 6 mounted to biasing means that comprise a strip shaped biasing arm 60 (also called a spring blade arm), connected to the rotary support 2 via a locking plate 62 and a base 64. The locking plate 62 is screwed into the base 64, fixing the spring blade arm 60 thereto so that, preferably, the spring blade arm 60 extends away from the support 2 at an oblique angle. The spring blade arms 60 are preferably regularly distributed around the disk-shaped plate 2, but can also be distributed randomly or at variable distances from one another. This preferred embodiment further comprises a protective plate 30 shielding the biasing means and comprising openings 38 through which the abrasive tools 6 are urged.

Referring to FIGS. 21 to 24, the seventh preferred embodiment of the aging device 1 is provided with an abrasive tool 6 mounted to biasing means that comprise an L-shaped biasing arm 70 operatively connected to a rubber suspension unit 72. The suspension unit, such as a ROSTA® type unit, which can also be made of a rubber-like material enabling a biasing effect, is mounted to the rotary support 2. The L-shaped biasing arm 70 comprises a vertical strip 75 and a horizontal strip, said horizontal strip having a first 73 and second end 71. The vertical strip 75 of the L-shaped biasing arm 70 is operatively connected to the suspension unit 72 at a pivot point 74. The L-shaped arm 70 is able to pivot relative to the pivot point 74, thus loading the suspension unit 72. The biasing arm 70 rocks back and forth on the pivot 74, depending on the forces applied on the abrasive tool 6. In this preferred embodiment, the aging device is provided with a protective plate 30 comprising openings 38 through which the abrasive tool 6 is urged. The biasing means are preferably preloaded by the protective plate 30, the latter engaging and loading the second end 71 toward the disk-shaped plate 2 in a relaxed position. Preferably, the horizontal strip has its flat face facing in the axial direction of the disk-shaped plate 2. Also, the horizontal strip preferably has a curve in it between the first 73 and second 71 ends. The suspension units 72 are advantageously distributed over the surface of the disk-shaped plate 2 so that a large surface of the stone can be instantaneously engaged by a plurality of abrasive tools 6. The horizontal strips of the L-shaped biasing arms 70 preferably extend tangentially away from the direction of rotation of the device 1.

Figure 26:
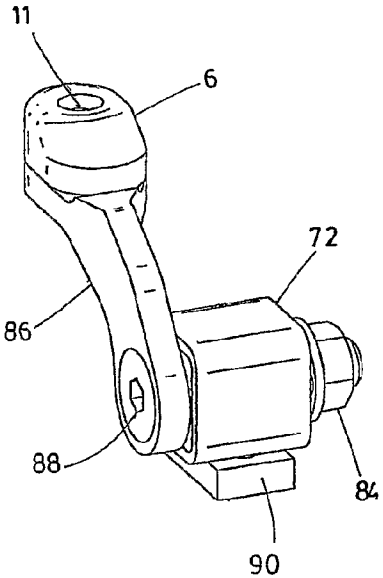
FIG. 26 is an enlarged perspective view of region XXVI of FIG. 25.
Figure 25:
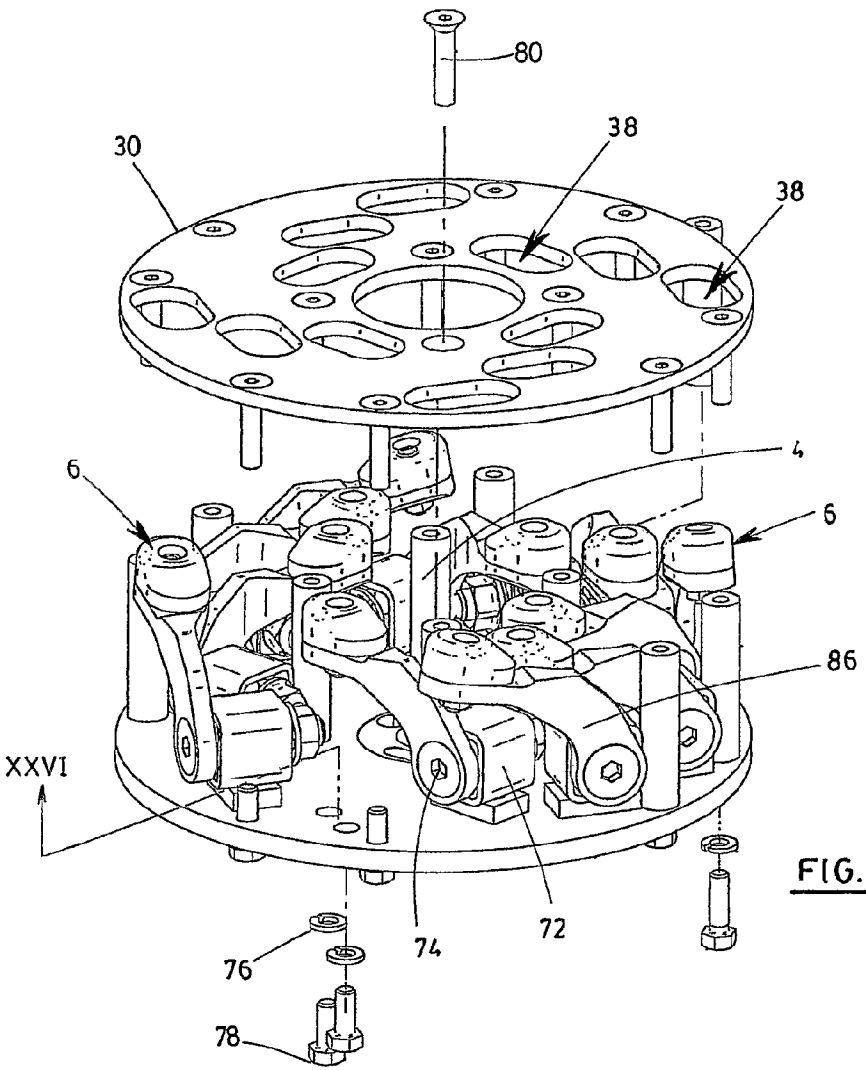
FIG. 25 is an exploded top perspective view of the aging device according to the eighth embodiment of the invention.

Referring to FIGS. 25 and 26, the eighth preferred embodiment of the aging device 1 is provided with an abrasive tool 6 mounted to biasing means that comprise a curved biasing arm 86 operatively connected to a suspension unit 72 such as that of the seventh embodiment. The suspension unit 72 is mounted to the disk-shaped plate 2 via bases 90, which are preferably fixed to the disk plate 2 with a washer 76 and bolt 78 system. In this preferred embodiment as well, a protective plate 30 is mounted to the disk-shaped plate 2 with the aid of fasteners, and helps to shield the curved biasing arms 86 and suspension units 72. Also, the rotary shaft 4 is advantageously fixed to the disk-shaped plate 2 with a fastener 80. The curved arms 86 are pivotally mounted to the suspension units 72 at a pivot point 74, preferably with the aid of a nut 84 and bolt 88 system.

Figure 27:
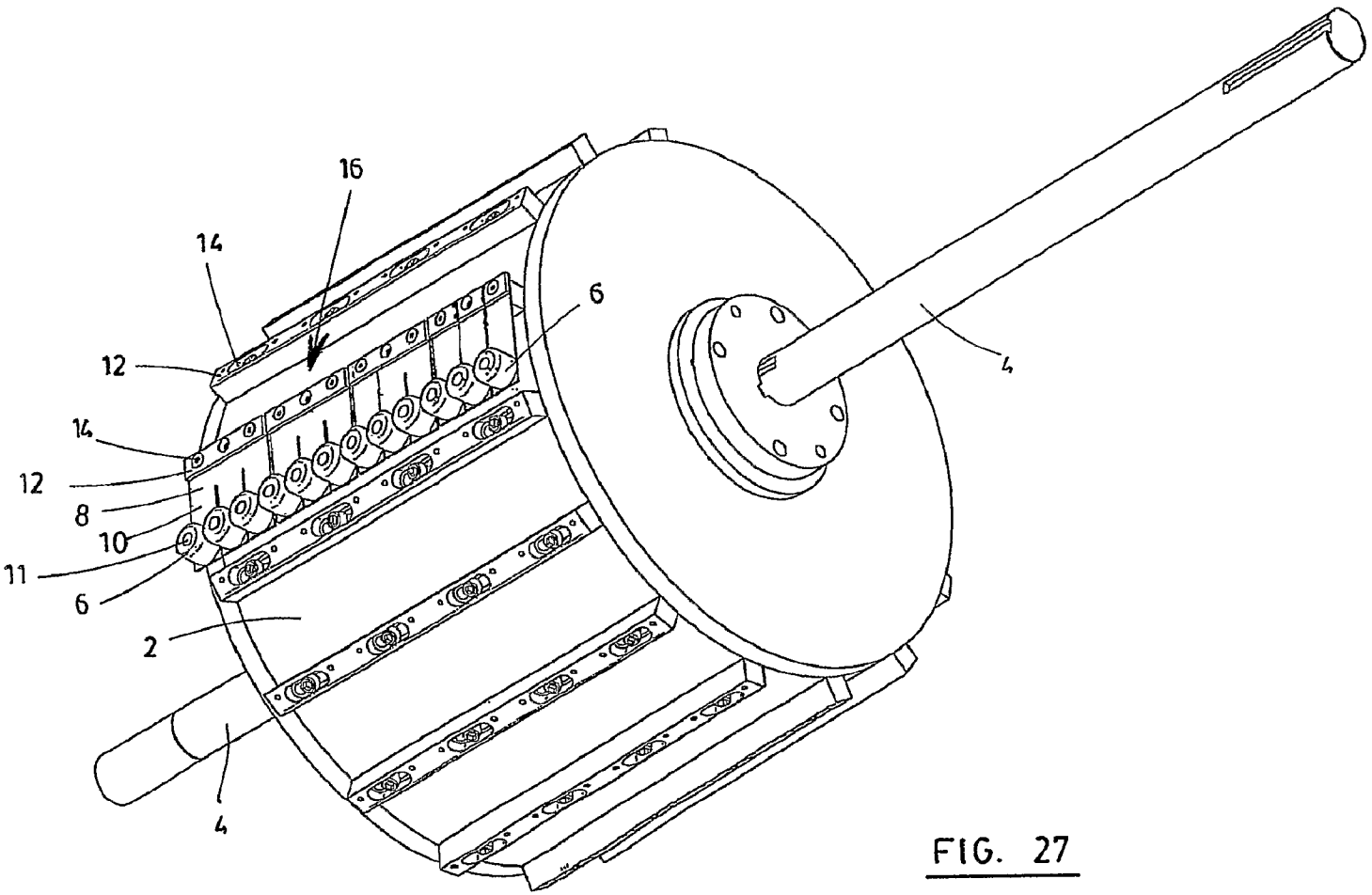
FIG. 27 is a perspective view of the aging device according to the ninth preferred embodiment of the invention, wherein the abrasive tools are mounted to a cylindrical rotary support. For the sake of clarity, only one set of abrasive tools is illustrated.

Referring to FIG. 27, the ninth preferred embodiment of the aging device 1 comprises a rotary support 2 in the form of a cylinder that is rotated on a rotary shaft 4. FIG. 27 shows biasing means in accordance with the first preferred embodiment described hereinabove; however, any of the other biasing means could be used and adapted for use with the cylindrical rotary support 2 by someone skilled in the art. In the embodiment shown in FIG. 27, rows of spring blades 8 are distributed all around the cylindrical plate. The abrasive tools are preferably made of carbide or stainless steel, but can also be any abrasive compound or composite suitable for roughing and/or polishing artificial stones. Also, the number and shape of abrasive tools 6 can be determined according to the desired result. The embodiment of the cylindrical rotary support is particularly advantageous when the side edges of a stone are to be aged, or the peripheral edges of the stone are to be aged. A protective cylindrical plate (not shown) could be used to cover the cylinder.

It should be understood that certain features of the above mentioned embodiments may be used in other embodiments. For example, the protective plate 30 can be used to protect and/or preload the biasing means of other embodiments than those for which it was specifically mentioned.

The apparatus is preferably used in conjunction with another aspect of the invention, that is, the inventive aging method. This method includes bringing the artificial stone into rotational contact with at least one abrasive tool. Preferably there are many abrasive tools engaging the stone. The method also calls for the abrasive tools to be urged toward the surface of the artificial stone while allowing the abrasive tools to move away therefrom. In this way, the abrasive tools are able to follow a surface profile of the stone material while roughing and/or polishing the surface thereof. The rotational contact between the abrasive tools and the stone is maintained until the latter is adequately aged.

The aging device is preferably installed on the handling system in order for the abrasive tools to come into contact with the surfaces of the concrete blocks. A handling system such as a conveyor system (not shown) may be used to carry the concrete blocks under a reaching distance of the aging device, to achieve mass production. However, depending on the configuration of the apparatus or if desired, the stones or blocks may be treated one at a time. Upon rotation of the rotary support 2, driven by the conventional rotary shaft 4 at very high speed, the abrasive tools come into contact with the surfaces of the concrete blocks, thereby aging the surfaces and edges of the concrete blocks mostly by friction and also by impact.

Moreover, the aging device can be maintained in a static position as the stone moves under it, but the stone can also be static as the device is moved over top of it. Furthermore, both can be moving in a predetermined pattern relative to one another, said pattern involving rotational and/or translational movement.

Of course, in the preferred embodiments, as well as in other embodiments, the apparatus and method may be used in conjunction with other such apparatuses and methods to increase efficiency of the operation. It is also worth noting that the abrasive tools, as well as the biasing means and units, may differ from one apparatus to another, to give various finishes to the surfaces.

The components of the aging device are constructed using a variety of appropriate materials. The non flexing components can be made of steel or other robust metals or compounds. The biasing means (rods, spring arms, strips, etc) can be made of flexible/elastic polymers or metals. The suspension unit is one such as a ROSTA® suspension unit and is preferably made of a rubber or rubber-like material that can be easily loaded.

The operating conditions of the aging device can be modified according to the desired aging effect, the properties of the stone and the specific preferred embodiment employed. The tension of the springs and the biasing arms can be modified by varying the length, material or orientation thereof. The speed of rotation of the rotary support can be varied as well. The cylindrical plate can rotate, for example, at about 300 RPMs or above.

Another advantage of the aging apparatus according to the present invention is that it enables a delicate aging treatment of stones. This is particularly important for large, thin stone that break easily.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. An aging device for aging a stone, comprising:

a rotary support operatively connected to a rotary shaft, the rotary support being a cylinder that is rotated about a longitudinal axis thereof;

at least one abrasive tool mounted to a circumferential surface of the rotary support for roughing and/or polishing a surface and peripheral edges of the stone when the rotary support is brought into functional contact with the surface and the peripheral edges; and biasing means biasingly connecting the at least one abrasive tool to the rotary support, each one of the biasing means comprising a rigid biasing arm having a first arm end and a second arm end, the first arm end being connected to a suspension unit mounted to the rotary support and the second arm end being a free end extending away from the rotary support and bearing at least one of the at least one abrasive tool, the biasing means urging the at least one abrasive tool away from the rotary support while allowing the at least one abrasive tool to move toward the rotary support when the rotary support is brought into functional contact with the surface of the stone, thereby allowing the at least one abrasive tool to follow a surface profile of the stone while roughing and/or polishing the surface of the stone.

2. the aging device according to claim 1, wherein the suspension unit is composed of rubber.

3. The aging device according to claim 1, wherein the at least one abrasive tool comprises a plurality of abrasive tools distributed on the circumferential surface of the rotary support, each one of the plurality of abrasive tools being associated with a respective one of the biasing means.

4. The aging device according to claim 1, wherein the biasing arm of each biasing means extends obliquely relative to the rotary support and the second arm end of all of the biasing arms points in a same rotational direction.

5. The aging device according to claim 1, comprising a protective cylindrical plate mounted to the rotary support to substantially shield the biasing means, the protective cylindrical plate comprising at least one opening through which the at least one abrasive tool is urged by the biasing means.

6. An aging device for aging a stone, comprising:

a rotary support operatively connected to a rotary shaft, the rotary support being a cylinder that is rotated about a longitudinal axis thereof;

at least one abrasive tool mounted to a circumferential surface of the rotary support for roughing and/or polishing a surface and peripheral edges of the stone when the rotary support is brought into functional contact with the surface and the peripheral edges; and biasing means biasingly connecting the at least one abrasive tool to the rotary support, each one of the biasing means having a first end and a second end, the first end being fixed to the rotary support and the second end extending away therefrom, the second end bearing at least one of the at least one abrasive tool, the biasing means urging the at least one abrasive tool away from the rotary support while allowing the at least one abrasive tool to move toward the rotary support when the rotary support is brought into functional contact with the surface of the stone, thereby allowing the at least one abrasive tool to follow a surface profile of the stone while roughing and/or polishing the surface of the stone.

7. The aging device according to claim 6, wherein the at least one abrasive tool comprises a plurality of abrasive tools distributed on the circumferential surface of the rotary support, each one of the plurality of abrasive tools being associated with a respective one of the biasing means.

8. The aging device according to claim 7, wherein each one of the biasing means comprises a biasing arm having a first arm end opposite a second arm end, the first arm end being operatively connected to the rotary support and the second arm end being a free end extending away from the rotary support and bearing a respective one of the plurality of abrasive tools.

9. The aging device according to claim 8, wherein the biasing arm of each biasing means extends obliquely relative to the rotary support and the second arm end of all of the biasing arms points in a same rotational direction.

10. The aging device according to claim 9, wherein the biasing arm is a flexible spring arm.

11. The aging device according to claim 9, wherein the biasing arm is blade shaped.

12. The aging device according to claim 9, wherein the biasing arm is rod shaped.

13. The aging device according to claim 6, comprising a protective cylindrical plate mounted to the rotary support to substantially shield the biasing means, the protective cylindrical plate comprising at least one opening through which the at least one abrasive tool is urged by the biasing means.

* * * * *